US008881868B2

(12) United States Patent
Cummings

(10) Patent No.: US 8,881,868 B2
(45) Date of Patent: Nov. 11, 2014

(54) MATERIAL SUPPORT ASSEMBLY

(75) Inventor: Paul Cummings, Bicester (GB)

(73) Assignee: Bluesky Solutions Limited, Marlow, Buckinghamshire (GB)

( * ) Notice: Subject to any disclaimer, the term of this patent is extended or adjusted under 35 U.S.C. 154(b) by 222 days.

(21) Appl. No.: 12/387,891

(22) Filed: May 8, 2009

(65) Prior Publication Data

US 2012/0305332 A1 Dec. 6, 2012

(30) Foreign Application Priority Data

May 9, 2008 (GB) ..... 0808436.0

(51) Int. Cl.
*B66F 11/04* (2006.01)
*E04G 5/00* (2006.01)

(52) U.S. Cl.
CPC .. *E04G 5/00* (2013.01); *B66F 11/04* (2013.01)
USPC ..... 182/129

(58) Field of Classification Search
USPC ..... 182/129
See application file for complete search history.

(56) References Cited

U.S. PATENT DOCUMENTS

| | | | | | |
|---|---|---|---|---|---|
| 733,469 | A * | 7/1903 | Dunbrook | 212/241 |
| 1,952,238 | A * | 3/1934 | Dice | 212/324 |
| 2,072,398 | A * | 3/1937 | Faulk | 254/329 |
| 3,978,989 | A * | 9/1976 | Avila, Jr. | 212/176 |
| 4,877,069 | A * | 10/1989 | Plumley | 144/286.1 |
| 5,439,152 | A * | 8/1995 | Campbell | 224/405 |
| 5,638,914 | A * | 6/1997 | Kizzia | 182/45 |
| 6,039,150 | A * | 3/2000 | Palmer | 182/113 |
| 6,435,360 | B1 * | 8/2002 | Buchmeier | 212/180 |
| 6,557,667 | B1 * | 5/2003 | Ward | 182/129 |
| 7,070,059 | B1 * | 7/2006 | Flowers et al. | 212/180 |
| D596,761 | S * | 7/2009 | Beland | D25/68 |
| 7,963,367 | B2 * | 6/2011 | Wilson | 182/112 |
| 2004/0218997 | A1 | 11/2004 | Neubauer et al. | |

FOREIGN PATENT DOCUMENTS

| | | | |
|---|---|---|---|
| AT | 363 222 | B | 7/1981 |
| DE | 20218395 | U1 | 3/2003 |
| GB | 2 390 079 | A | 12/2003 |
| GB | 2 390 597 | A | 1/2004 |
| GB | 2 397 055 | A | 7/2004 |
| GB | 2 398 556 | A | 8/2004 |
| GB | 2 439 301 | A | 12/2007 |
| GB | 2 440 931 | A | 2/2008 |

OTHER PUBLICATIONS

European Search Report for European Patent Application No. EP 09 25 1277, mailed Aug. 21, 2009.
United Kingdom Search Report for Great Britain Application No. GB 0808436.0, dated Aug. 13, 2008.

* cited by examiner

*Primary Examiner* — Alvin Chin-Shue
(74) *Attorney, Agent, or Firm* — Foley & Lardner LLP

(57) ABSTRACT

A material support assembly (21) for use on an aerial lift work platform (12) surrounded by a safety barrier (17) with a kick plate (14) adjacent the platform (12), the assembly (21) having at least one leg (22 or 23) mounted on a foot (24) which rests on the platform (12), the leg and foot having a first coupling means (31) for securing the assembly (21) to the kick plate (14) on one side of the platform and a further coupling means (32) for engaging the kick plate (14) on the opposite side of the platform, the further coupling means (32) preferably being located at the end of an arm (25) extending away from the foot (24) and resting against the platform.

1 Claim, 6 Drawing Sheets

MATERIAL SUPPORT ASSEMBLY

FIELD OF THE INVENTION

This invention relates to a material support assembly which in use may form part of a storage rack in particular for the storage of lengths of material, in particular pipes or tubes, during construction of buildings.

BACKGROUND OF THE INVENTION

Building construction sites for large buildings frequently employ construction equipment for lifting large and heavy components into position during the construction of a building. For example, lengths of standard 8 inch (200 mm) diameter steel pipe are typically 6 meters in length and may weigh in the order of 150 kgs. During construction of commercial building the overhead pipe work is typically lifted and fixed into position using aerial lifts.

A typical aerial lift is a mobile scissor lift available from JLG Ind. and which has a work platform which may be lifted into the air by a hydraulically operable scissor mechanism. For safety the work platform is surrounded by a safety barrier or fence.

As is described in the applicants co-pending GB patent Application GB-A-2439 301 these lifts may be provided with a pipe storage rack which is secured to the lift platform by engagement with a portion of the kick plate which forms part of the safety barrier.

The present invention provides an improved material storage assembly for use on an aerial lift and which can be independently fitted to the lift platform without the need to drill or tap holes in the platform.

STATEMENTS OF INVENTION

According to a first aspect of the present invention there is provided a material support assembly for use on an aerial lift having a work platform surrounded by a safety barrier with a kick plate adjacent the platform, the support assembly having at least one leg mounted on a foot which in use rests on the platform, the leg and foot having a first coupling means for securing the assembly to a first portion of the kick plate to one side of the platform and also being connected to a further coupling means for engaging a second portion of the kick plate on the opposite side of the platform.

The support is thus held in place by engaging with the kick plate on opposite sides of the platform and is held in stable condition resting on the platform.

Preferably the further coupling means is provided on an arm which extends away from the foot and in use also rests against the platform, the further coupling means being located at the distal end of said arm.

The coupling means may be adjustably connected to the foot, and/or the further coupling means may also be adjustably connected to the foot. Preferably the material support assembly comprises a pair of spaced apart legs each secured to a foot plate, with a third leg secured to the arm.

Each leg of said pair of legs has a coupling means at its lower end portion provided in the form of a catch which is engagable with the kick plate to hold the foot plate adjacent the kick plate, and the arm has a like catch thereon forming the further coupling means. The coupling means on each leg of said pair may be formed integrally with each other as a single catch. The catch means may comprise open hooks.

The upper end portions of each leg are connected to a triangular material support, preferably with its apex attached to the third leg.

The invention also comprises a material support rack comprising two material support assemblies arranged side by side.

The invention further comprises an aerial lift having a work platform surrounded by a safety barrier including a kick plate adjacent the platform, and a material storage assembly according to the first aspect of the invention, or a storage rack according to the second aspect of the invention, located within the safety barrier and having its foot and arm in use resting on the platform with the respective coupling means securing each assembly to portions of the kick plate.

The kick plate on an aerial lift typically has an upper edge with either an inwardly or an outwardly turned lip which may be further provided with a downwardly turned lip flange. The catches on the legs and arm may engage with the lip and flange of the kick plate either by insertion into the underside of the inwardly extending lip or by hooking over the outwardly extending lip. In an alternative arrangement the coupling means may engage over the lip.

Alternatively, the kick-plate may comprise a substantially flat plate, and the coupling means engages both sides of the flat plate.

According to yet another aspect of the present invention there is provided a method of securing a material storage assembly or rack to an aerial lift having a work platform surrounded by a safety barrier with a kick plate adjacent the platform, wherein each assembly has at least one leg having a foot plate and arm which in use rest on the platform, the leg and arm having a coupling means thereon for securing the rack to said kick plate, wherein in said method the leg and arm are coupled to the kick plate with the foot and arm then rested on the platform in the following steps; the leg and foot, separate from the arm, are caused to engage the respective coupling means with a first portion of the kick plate and the foot then rested on the platform, the coupling means on said arm is caused to engage with a second portion of the kick plate, the portion of said arm including the coupling then being attached to foot.

The foot may comprise a plate and the leg and footplate may be tilted to engage the coupling means with the kick plate.

DESCRIPTION OF THE DRAWINGS

The invention will be described by way of example and with reference to the accompanying drawings in which.

DETAILED DESCRIPTION OF THE INVENTION

Figure 1:
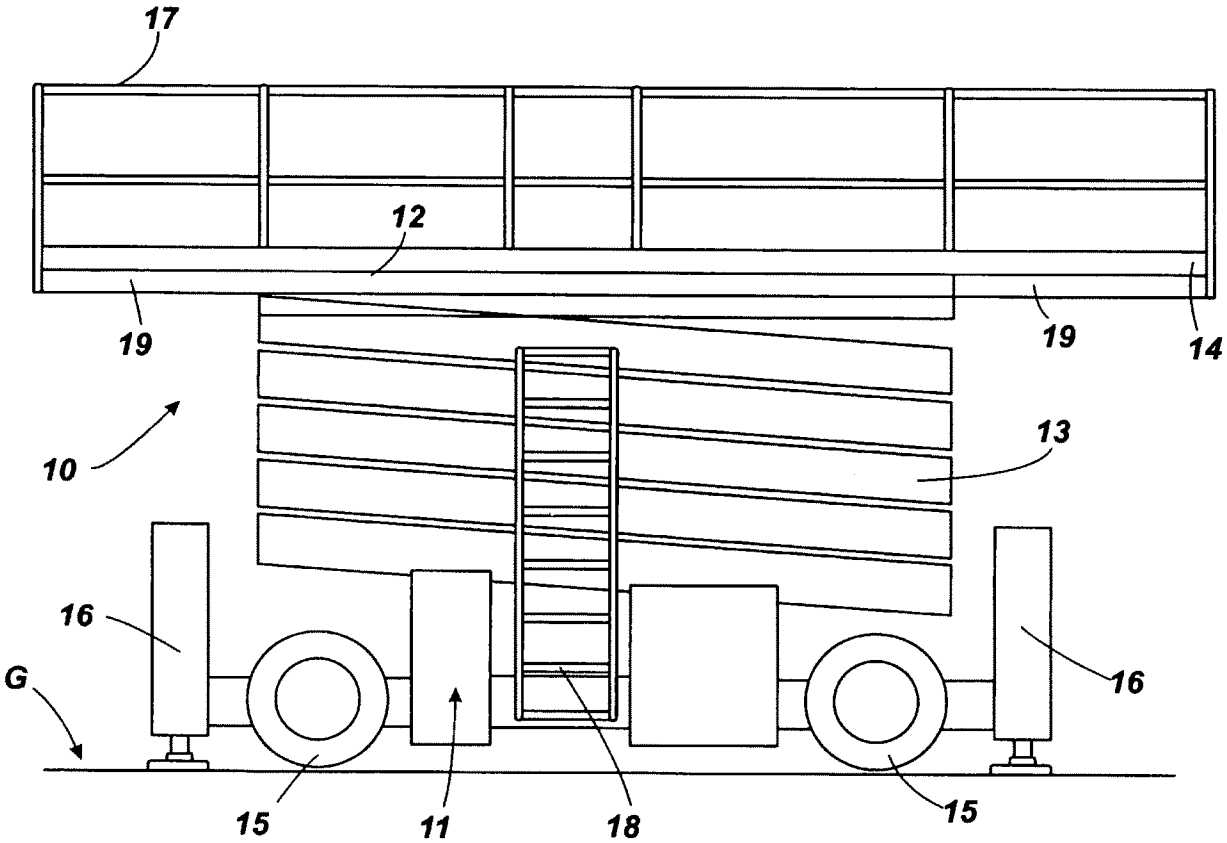
FIG. 1 is a side elevation of an aerial lift and platform

FIG. 1 shows an aerial lift 10 in the form of a self drive mobile scissor lift available from JLG Ind. The lift 10 has a drivable vehicle body 11 having wheels 15 and a work platform 12 located on its body and which in use can be raised or lowered relative to the ground G. The platform 12 is shown in a lowered condition and the vehicle body is provided with stabilisers 16 at its corners which are lowered to provide stability during use of the lift. The work platform 12 is raised or lowered by a scissor type mechanism 13 typically operated by a powered hydraulic system provided on the lift. The platform 12 has extendable end portions 19 and the whole platform is provided with a safety barrier 17 including a kick plate 14 adjacent the platform 12. The kick plate 14 typically has an upper edge with an outwardly and downwardly turned lip 20 (see FIG. 2). An access ladder 18 is provided on the body 11 for access to the platform 12 when in the lowered condition.

Figures 2, 4:
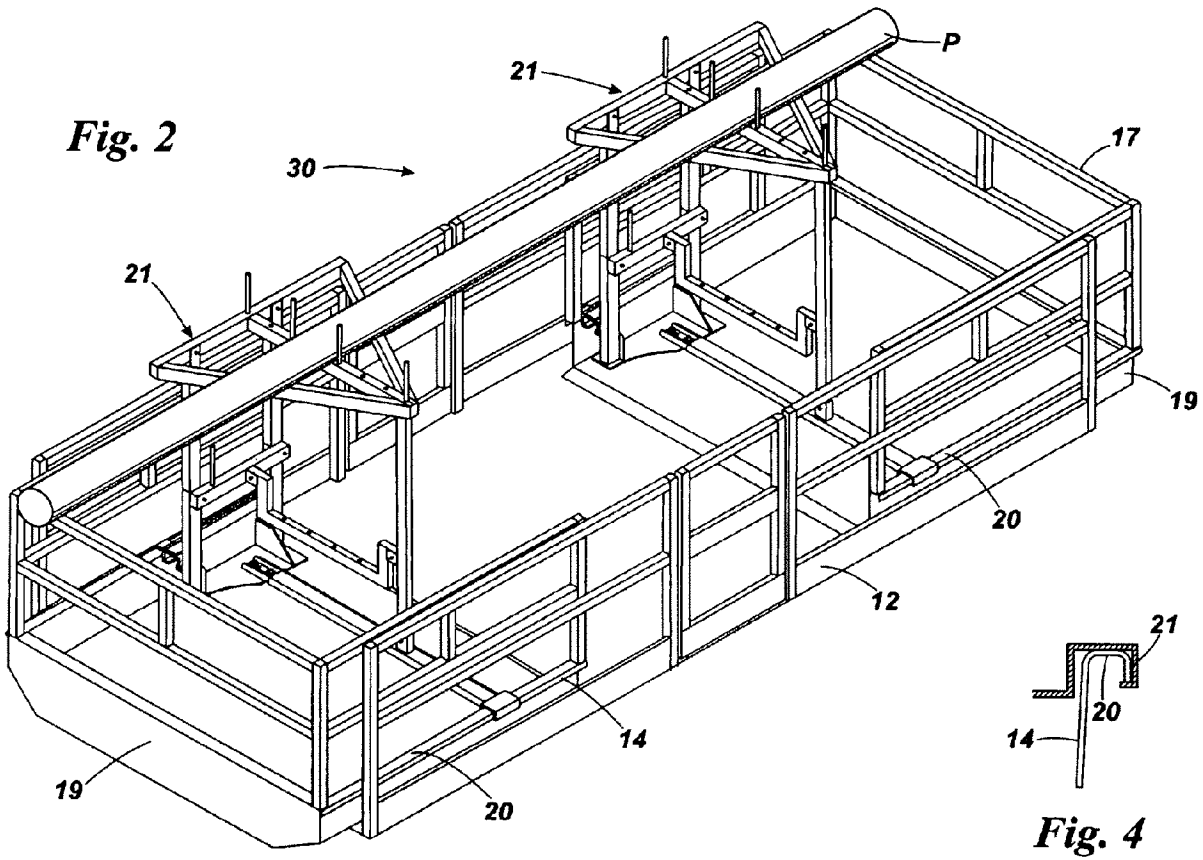
FIG. 2 is an isometric view of the platform having a material storage assembly according to the present invention.
FIG. 4 is section through a kick plate 14 showing the engagement of the over coupling device with an outwardly extending kick plate lip.
Figure 3:
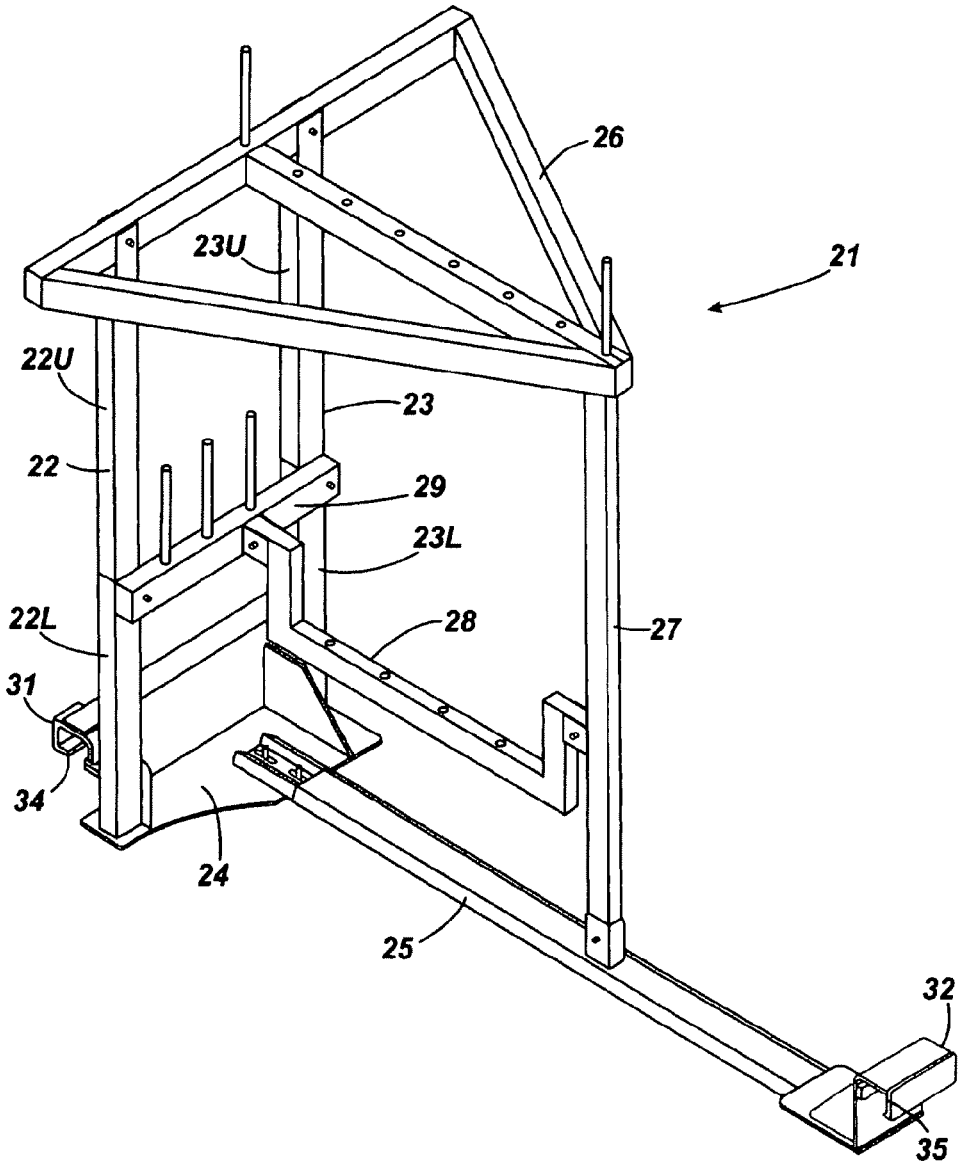
FIG. 3 is an isometric view of the storage assembly of FIG. 2.

With reference now to FIGS. 2 and 3, there is shown a pair of material support assemblies 21 mounted on the work platform 12. The two assembles 21 are spaced apart and are located one on each end portion 19 of the platform 12 forming a storage rack 30 for the storage of at least one pipe length P.

Each assembly 21 comprises a pair of spaced apart substantially vertical legs 22,23 secured to a foot plate 24 which in use rests on the floor of the platform 12. A support arm 25 extends away from the foot plate inwardly of the safety barrier 17 and also rests against the platform floor. A third substantially vertical leg 27 is secured to the arm 25.

Each leg 22 or 23 of said pair of legs may be formed from upper limbs 22U, 23U and lower limbs 22L, 23L secured together, with the lower limbs 22L,23L being secured to the footplate 24. The upper end portions of each leg 22,23,27 are connected to a triangular material support 26 with its apex attached to the third leg 27. The support 26 in use provides a support surface for the pipe P. A lower support bracket 28 may also be provided between the third leg 27 and a strut 29 extending between the two legs 22,23 fixed to the foot plate 24. Lengths of pipe may be stored across the two support brackets 28. The assembly 21 is constructed from a kit of interconnected parts.

The support assemblies 21 are preferably arranged on the platform floor, adjacent the safety barrier 17 and kick plate 14. The lower portions 22L,23L of the two legs 22,23 are provided with coupling means 31 thereon for securing the assembly 21 to a first portion of the kick plate 14 on one side of the platform. The arm 25 has a further coupling means 32 at its distal end thereof for engaging a second portion of the kick plate 14 on the opposite side of the platform. The coupling means 31,32 are in the form of a catch which is engagable with the kick plate 14 to hold the respective foot plate 24 and arm 25 to the kick plate. The coupling means 31 on the two legs 22,23 may be formed integrally with each other as a single catch.

The catch 32 may be detachably and adjustably mounted to the distal end portion of the arm 25 and the arm in turn may be detachably and adjustably mounted to the foot plate 24.

The catches 31,32 each comprise an open hook portion 34,35 respectively which can engage over the outwardly extending lip 20 and turned down flange 21 on the kick plate 14 (see FIG. 4)

The material storage assembly 21 is attached to the platform 12 by separately coupling the two legs 22,23 to the kick plate 14. The legs 22,23 with the footplate 24 are titled to cause the coupling means 31 to engage over the lip 20 and flange 21 with the hook 34 under the under the kick plate lip of a first portion of the kick plate. The legs 22,23 are then moved upright to rest the foot plate 24 on the platform floor. The coupling means 32 on said arm 25 is then similarly caused to engage with a second and opposite portion of the kick plate 14. The coupling means 32 is then secured to the arm 25 which in turn is secured to foot plate 24.

The material storage assembly 21 is secured in a stable manner on the platform by means of the two coupling means 31 32, engaging on opposite sides of the kick plate with the foot plate 24 and arm 25 resting firmly on the platform.

Figure 5:
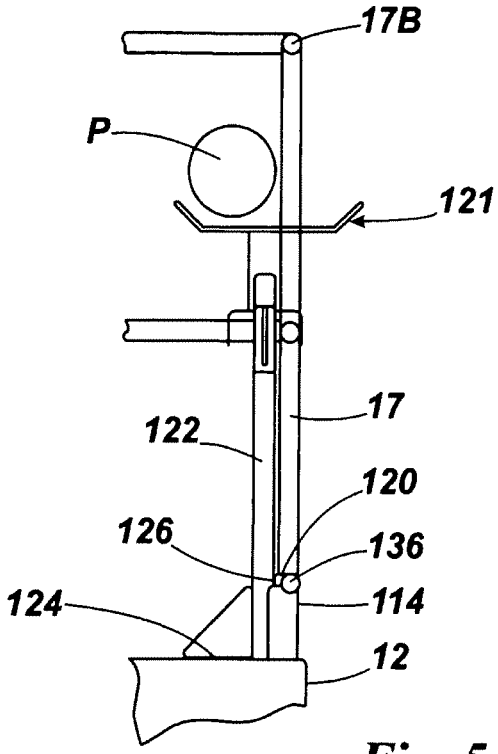
FIG. 5 is a side elevation of one side of a second storage assembly showing an alternative coupling device engaging a kick plate with an inwardly extending lip.
Figure 6:
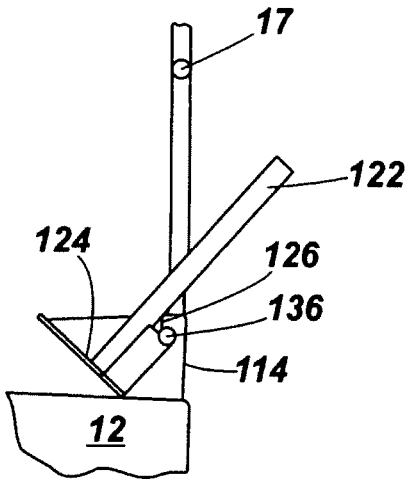
FIG. 6 is a side elevation of the assembly of FIG. 5 during fitting.

With reference to FIGS. 5 and 6, there is shown a second type of kick plate 114 having an upper edge with an inwardly extending lip 120 and downwardly turned flange 126. The storage assembly 121 may be substantially as described with reference to FIG. 3 or may be of any other suitable assembly forming part of a storage rack, such as is disclosed in published EP Application 1873 115. For simplicity only one catch means 136 is shown, the catch means on the arm being substantially the same.

The assembly has at least one leg 122, and preferably two spaced apart legs as shown in FIG. 3, each of which has a footplate 124 at its lower end which in use rests on the platform 19, as previously described. The arm 25 (not shown) is attached to the footplate 24 as previously described and also rests against platform floor. The differences in relation to FIG. 3 lie in the coupling means 136 which are used for attachment to the different kick plate 114. The legs 122 and the arm 25 are provided with a coupling means 136 in the form of a rod for engagement under lip 120. The lower portion of each leg 122 is provided on an outwardly facing surface (outward with respect to the platform) with the rod-like catch 136 adjacent its foot plate 124 being engagable within the downwardly turned flange 126 of the kick plate 114, to hold the respective footplate in proximity to the kick plate 114.

A similar catch is provided at the distal end of the arm 25 for engagement under the kick plate lip 126 on the opposite side of the platform 12.

The storage assembly may comprise a triangular platform 26 as previously described as previously described, or other suitable support.

Figure 7:
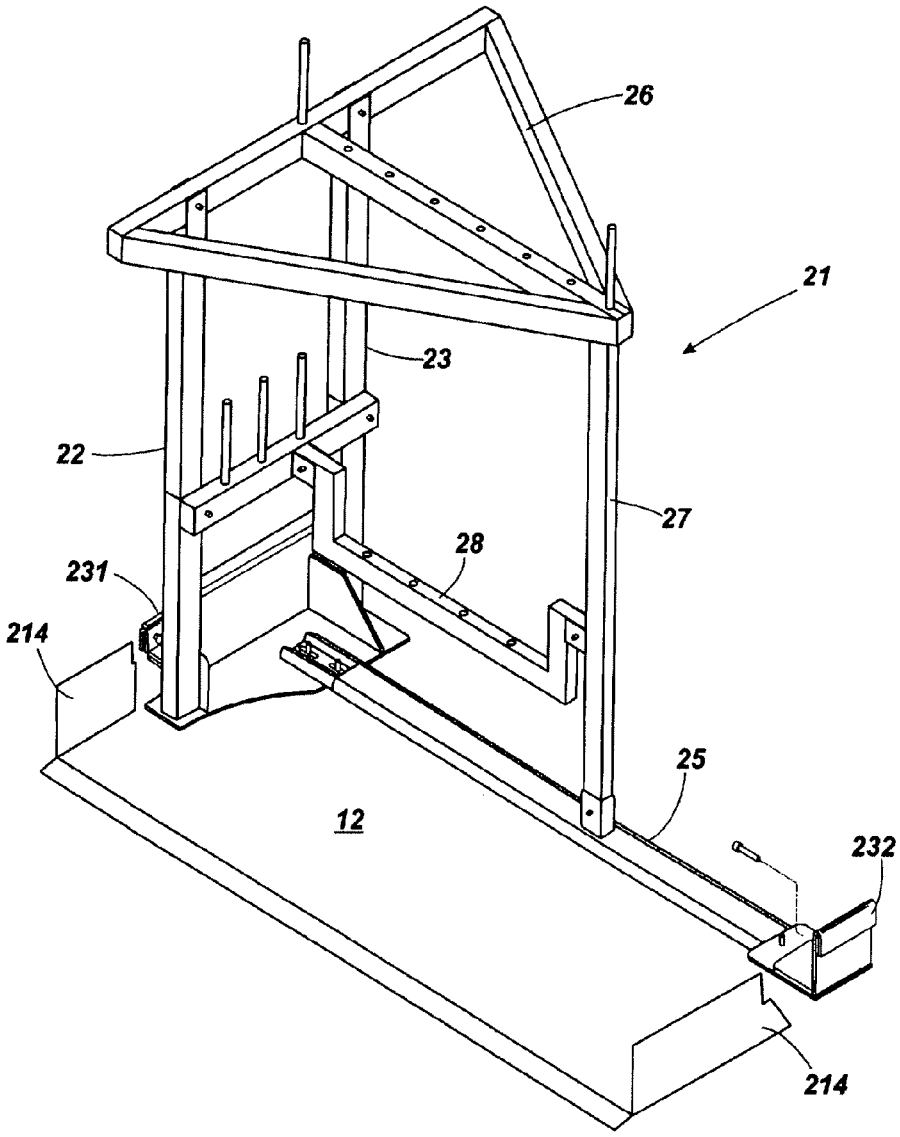
FIG. 7 is an isometric view of material storage assembly similar to FIG. 2 having yet another coupling device.

With reference now to FIG. 7 there is shown a platform 12 having a flat kick plate 214 without any lip on its upper edge. The storage assembly 21 is identical to that shown in FIGS. 2 & 3 except for the coupling means 231 and 232 for engaging the kick plate. The coupling means 231,232 are each in the form of an inverted U section hook which is immediately turned back on itself so that the hook closely embraces both sides of the flat kick plate 214.

Figure 8:
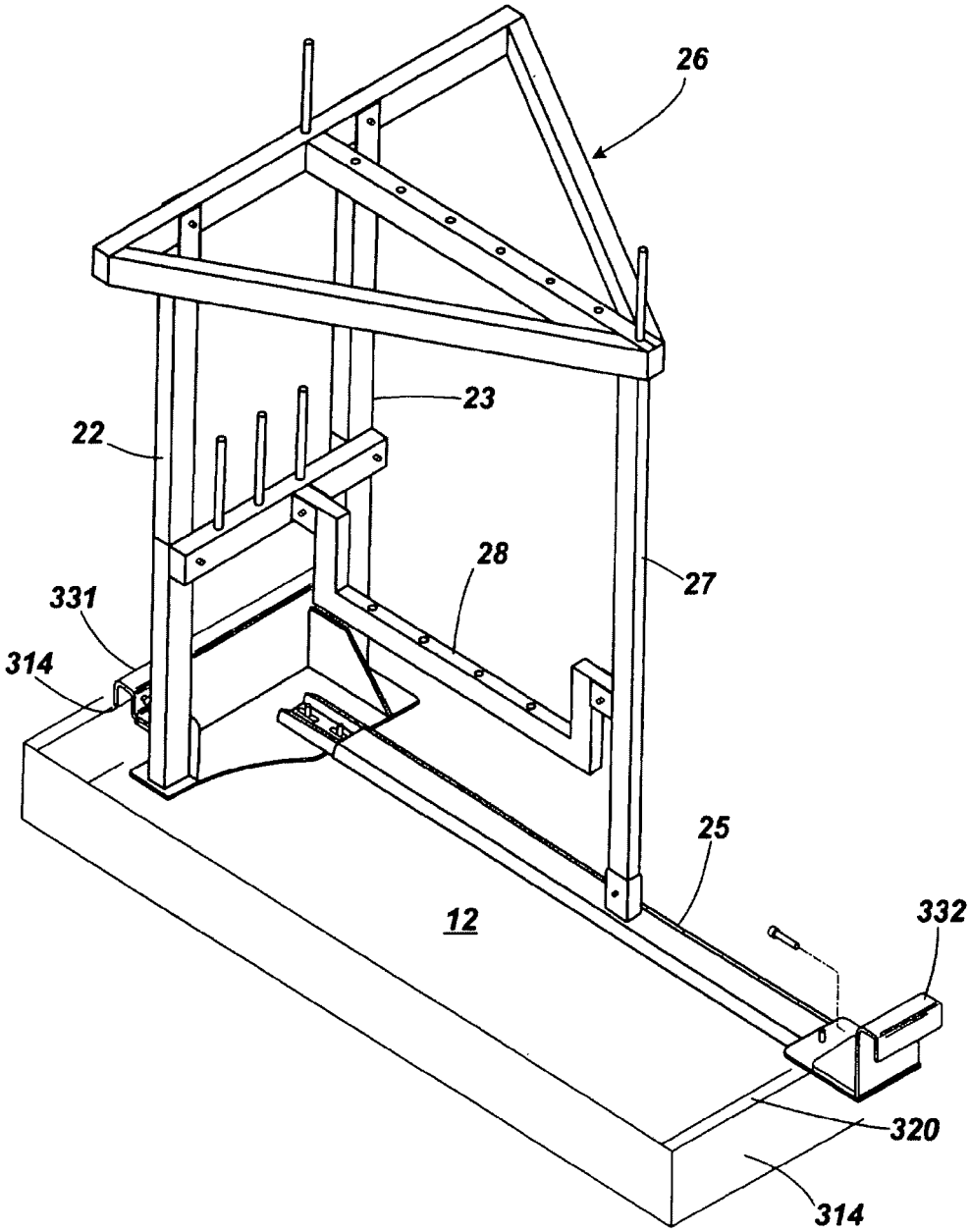
FIG. 8 is an isometric view of material storage assembly similar to FIG. 2 having yet a further coupling device.

With reference now to FIG. 8, there is shown a platform 12 having a flat kick plate 314 with a lip 320 on its upper edge which is turned inwardly of the platform. The storage assembly 21 is identical to that shown in FIGS. 2 & 3 except for the coupling means 331 and 332 for engaging the kick plate 314. The coupling means 231,232 are each in the form of an inverted U section open hook which is turned back on itself so that the hook closely embraces both sides of the kick plate 314 and lip 320.

What is claimed is:

1. A material support assembly for use on an aerial lift having a work platform surrounded by a safety barrier with a kick plate adjacent the work platform, the material support assembly having at least one leg mounted on a foot which in use rests on the work platform, the leg and foot having a first coupling means for securing the material support assembly to a first portion of the kick plate on one side of the work platform and being connected to a further coupling means for engaging a second portion of the kick plate on the opposite side of the work platform, the further coupling means is provided on an arm which extends away from the foot and also rests against the work platform, the further coupling means being located at the distal end of said arm;

the material support assembly comprises a second leg spaced apart from said leg and also mounted to said foot, and a third leg secured to the arm, and the upper end portions of each leg are connected to a triangular material support with its apex attached to the third leg.

* * * * *

UNITED STATES PATENT AND TRADEMARK OFFICE

CERTIFICATE OF CORRECTION

PATENT NO. : 8,881,868 B2
APPLICATION NO. : 12/387891
DATED : November 11, 2014
INVENTOR(S) : Paul Cummings It is certified that error appears in the above-identified patent and that said Letters Patent is hereby corrected as shown below:

In The Claims

Claim 1, Column 4, Line 65-66, “in use” should be deleted.

Signed and Sealed this
Twenty-third Day of February, 2016

Michelle K. Lee

Michelle K. Lee
*Director of the United States Patent and Trademark Office*